US008894358B2

(12) United States Patent
Bacic

(10) Patent No.: US 8,894,358 B2
(45) Date of Patent: Nov. 25, 2014

(54) CLEARANCE CONTROL ARRANGEMENT

(75) Inventor: Marko Bacic, Abthorpe (GB)

(73) Assignee: Rolls-Royce PLC, London (GB)

( * ) Notice: Subject to any disclaimer, the term of this patent is extended or adjusted under 35 U.S.C. 154(b) by 511 days.

(21) Appl. No.: 13/312,319

(22) Filed: Dec. 6, 2011

(65) Prior Publication Data

US 2012/0156007 A1 Jun. 21, 2012

(30) Foreign Application Priority Data

Dec. 16, 2010 (GB) ..... 1021327.0

(51) Int. Cl.
*F01D 11/20* (2006.01)

(52) U.S. Cl.
CPC ..... *F01D 11/20* (2013.01); *F05D 2260/407* (2013.01)
USPC ..... 415/126; 415/173.2

(58) Field of Classification Search
USPC ..... 415/126, 173.2, 14
See application file for complete search history.

(56) References Cited

U.S. PATENT DOCUMENTS

| | | | | |
|---|---|---|---|---|
| 5,344,284 | A | 9/1994 | Delvaux et al. | |
| 5,545,007 | A | 8/1996 | Martin | |
| 6,088,214 | A * | 7/2000 | Malone et al. | 361/278 |
| 6,142,477 | A | 11/2000 | Meinzer | |
| 6,659,716 | B1 | 12/2003 | Laurello et al. | |
| 7,079,957 | B2 * | 7/2006 | Finnigan et al. | 702/33 |
| 7,448,849 | B1 * | 11/2008 | Webster et al. | 415/173.1 |
| 7,654,791 | B2 * | 2/2010 | Werner | 415/1 |
| 2006/0245910 | A1 | 11/2006 | Buchal et al. | |
| 2008/0063509 | A1 * | 3/2008 | Sutherland et al. | 415/14 |
| 2008/0267770 | A1 | 10/2008 | Webster et al. | |
| 2009/0317228 | A1 | 12/2009 | Werner | |

FOREIGN PATENT DOCUMENTS

| | | | |
|---|---|---|---|
| DE | 10 2009 006 029 | A1 | 7/2010 |
| EP | 2 239 423 | A1 | 10/2010 |
| FR | 2 943 717 | A1 | 10/2010 |
| GB | 2 195 715 | A | 4/1988 |
| GB | 2 363 864 | A | 1/2002 |
| JP | A-1-267301 | | 10/1989 |
| WO | WO 2010083805 | A1 * | 7/2010 |

OTHER PUBLICATIONS

Search Report issued in European Patent Application No. 11 19 2176 dated May 16, 2013.
British Search Report issued in British Application No. GB1021327.0 dated Apr. 7, 2011.

* cited by examiner

*Primary Examiner* — Edward Look
*Assistant Examiner* — Michael Sehn
(74) *Attorney, Agent, or Firm* — Oliff PLC

(57) ABSTRACT

A clearance control arrangement includes first and second components defining a clearance therebetween. The first component includes a surface portion having at least a layer of material that changes thickness when actuated. The clearance control arrangement also includes an actuator to actuate the layer of material.

18 Claims, 4 Drawing Sheets

CLEARANCE CONTROL ARRANGEMENT

BACKGROUND

The present invention relates to a clearance control arrangement, in particular, although not exclusively, a tip clearance control arrangement for controlling the clearance of rotor blades in casings in gas turbine engines.

A gas turbine engine 10 is shown in FIG. 1 and comprises an air intake 12 and a propulsive fan 14 that generates two airflows A and B. The gas turbine engine 10 comprises, in axial flow A, an intermediate pressure compressor 16, a high pressure compressor 18, a combustor 20, a high pressure turbine 22, an intermediate pressure turbine 24, a low pressure turbine 26 and an exhaust nozzle 28. A nacelle 30 surrounds the gas turbine engine 10 and defines, in axial flow B, a bypass duct 32.

Each of the compressors and turbines comprise alternating stages of rotating blades and stationary stators surrounded by a casing. Engine efficiency is improved as the clearance between the rotating blade tips and the casing is minimised so that the working fluid passes over the blade surfaces and does not leak over the tips. However, differential heating of the components occurs during operation of the gas turbine engine. For an aero gas turbine engine used to power an aircraft, the radial growth of the blades is quicker than the radial growth of the casing when the engine accelerates, for example during take off and climb manoeuvres. Thus the minimum clearance between the blade tips and the casing must be set for the worst case scenarios, e.g. take off and step climb. At other flight phases the blades radially shrink more than the casing so that the clearance is larger than optimal.

Selective case cooling has been used to decrease the clearance during aircraft cruise. However, the clearance cannot be wholly minimised because the casing must be able to radially grow quickly enough that the blade tips do not rub against the casing during step climb manoeuvres.

Another method of decreasing the clearance during cruise has been to provide radially moveable segments of casing. These are generally mechanically complex and heavy, requiring significant actuation components. Additionally a casing segment is a relatively large component to move which cannot respond rapidly enough to transient aircraft manoeuvres such as step climb. Thus the minimum clearance must be specified at all flight phases as that required for take off, climb and step climb meaning that the engine is more inefficient in cruise. This is particularly expensive as cruise generally comprises the greatest proportion of the flight, at least for passenger and freight aircraft.

SUMMARY OF THE INVENTION

The present invention provides a clearance control arrangement that seeks to address the aforementioned problems.

Accordingly the present invention provides a clearance control arrangement comprising: first and second components defining a clearance therebetween; the first component comprising a surface portion having at least a layer of material that changes thickness when actuated; and an actuator to actuate the layer of material.

Advantageously this arrangement has a rapid response time which makes it ideal for fast transient control.

The clearance control arrangement may comprise a plurality of first components each defining a clearance relative to the second component and each having at least a layer of material that changes thickness when actuated. The actuator may actuate all the layers of material in synchronicity. Alternatively an actuator may be provided to actuate each layer of material individually.

The layer of material may comprise piezoelectric material and the actuator may comprise a voltage source. The surface portion may comprise the layer of piezoelectric material sandwiched between layers of metal. The voltage source may be connected to the layers of metal across the layer of piezoelectric material.

The layer of material may comprise a flexible membrane and the actuator may comprise an air supply. Alternatively the layer of material may comprise shape memory alloy and the actuator may comprise a heat source.

The clearance control arrangement may further comprise a controller to control actuation of the actuator.

The clearance control arrangement may further comprise a sensor to determine the clearance. The clearance control arrangement may further comprise a feedback loop between the sensor output and the controller. The sensor may be coupled to the surface portion or may be coupled to another part of the first component.

The present invention also provides a gas turbine engine comprising a clearance control arrangement as defined. The gas turbine engine may comprise a clearance control arrangement as defined for tip clearance control wherein the first component comprises a casing segment and the second component comprises a rotating blade.

The gas turbine engine may further comprise a cooling arrangement for controlling the temperature of the first component.

The present invention further provides a gas turbine engine comprising a clearance control arrangement for fan duct acoustic control.

The present invention will be more fully described by way of example with reference to the accompanying drawings, in which:

DETAILED DESCRIPTION OF THE INVENTION

Figure 1:
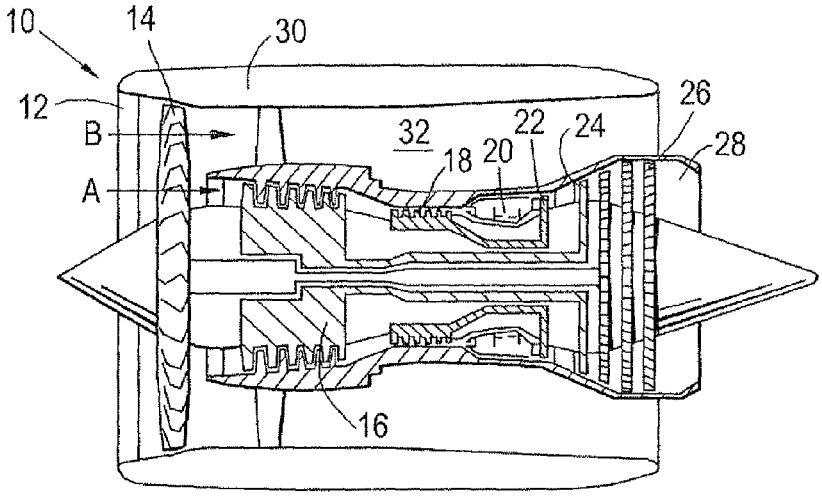
FIG. 1 is a sectional side view of a gas turbine engine.
Figure 2:
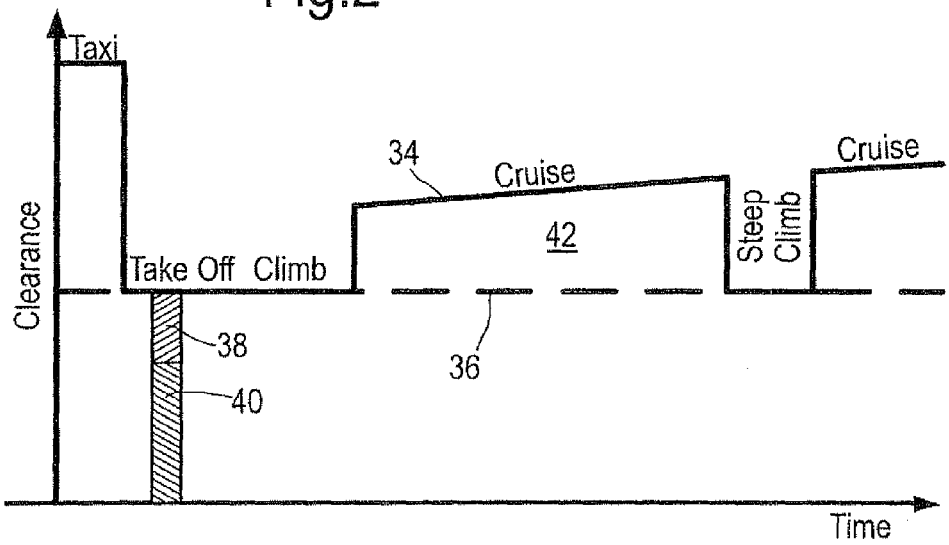
FIG. 2 is a schematic graph of clearance against time for an exemplary flight plan.

FIG. 2 illustrates a blade tip clearance 34 for a typical flight plan for a civil aircraft comprising sequential phases of runway taxi, take off, climb to altitude, cruise, step climb to a higher altitude and further cruise. It will be apparent to the skilled reader that there are further phases in a typical flight plan, including descent, landing and taxi, and that the step climb and further cruise phases may not occur or may be repeated. FIG. 2 also illustrates a target tip clearance 36 that is calculated as the sum of a clearance required to take account of measurement uncertainties or errors 38 and a clearance required to take account of asymmetries in the radial extent of the blade set 40. The blade tip clearance 34 is coextensive with the target tip clearance 36 when the engine 10 runs hottest, during take off, climb and step climb. During taxi the engine 10 has not reached full operating temperature and therefore the blade tip clearance 34 is much larger than the target tip clearance 36. During the cruise phases the blade tip clearance 34 increases beyond the target tip clearance 36. The area 42 between the blade tip clearance 34 and the target tip clearance 36 represents 'wasted' efficiency, since this is excess clearance beyond the minimum requirement.

The clearance control arrangement of the present invention reduces the blade tip clearance 34 towards the target tip clearance 36 during the cruise phase thereby improving the efficiency of the engine 10. This results in specific fuel consumption improvement, which equates to a significant fuel saving and thus cost saving over each flight.

Figure 3:
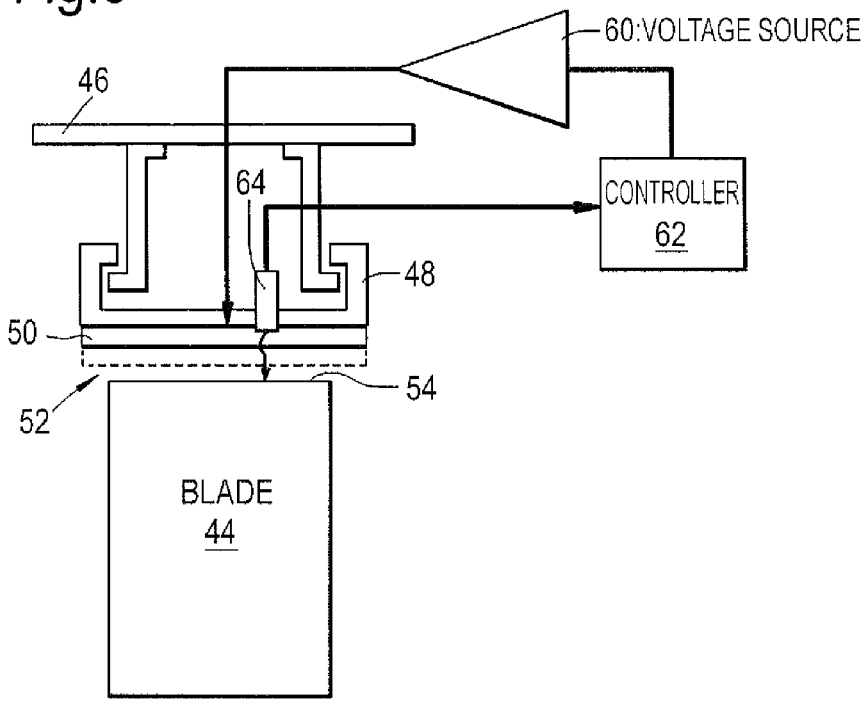
FIG. 3 is a schematic sectional view of a first embodiment of a clearance control arrangement according to the present invention.

An exemplary embodiment of the present invention is shown in FIG. 3 and illustrates a blade 44 rotating within a casing 46. The blade 44 is part of a rotor blade set, for example of the high pressure turbine 22. Coupled to the casing 46 is a shroud segment 48 that has a surface portion 50 which will be described in greater detail with respect to FIG. 4. A clearance 52 is defined between the surface portion 50 of the segment 48 and the tip 54 of the blade 44. It is this clearance 52 that is controlled by the clearance control arrangement of the present invention.

Figure 4:
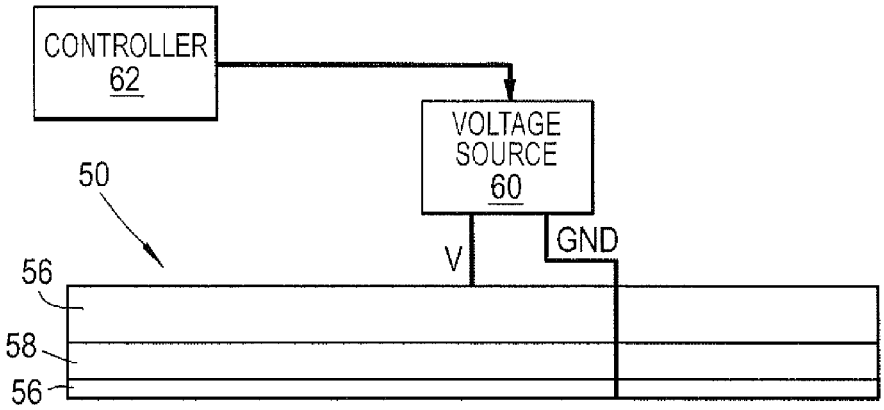
FIG. 4 is a schematic sectional view of part of a clearance control arrangement according to the present invention.

As shown in FIG. 4, the surface portion 50 of the segment 48 comprises a pair of metal layers 56 that sandwich a layer of material 58. The metal layers 56 may comprise nickel-alloy which is typically used for shroud segments 48. In one embodiment the layer of material 58 comprises a piezoelectric material. One terminal of a voltage source 60 is connected to each of the metal layers 56 so that a voltage is applied across the layer of piezoelectric material 58. The amount of voltage supplied by the voltage source 60 is controlled by a controller 62, for example in response to a feedback control loop. The controller 62 may be the engine electronic controller of the gas turbine engine 10 or a separate controller. The layer of piezoelectric material 58 increases in thickness with increasing applied voltage thereby causing the clearance 52 to reduce. In this way the blade tip clearance line 34 is brought closer to the target tip clearance line 36 on FIG. 2 and the efficiency and fuel consumption of the engine 10 is improved, particularly during cruise.

Although only two wires are shown connecting the voltage source 60 to the metal layers 56 it will be apparent to the skilled reader that there may be multiple pairs of wires deployed in parallel so that the voltage is applied evenly across the whole of the layer of piezoelectric material 58.

Figure 5:
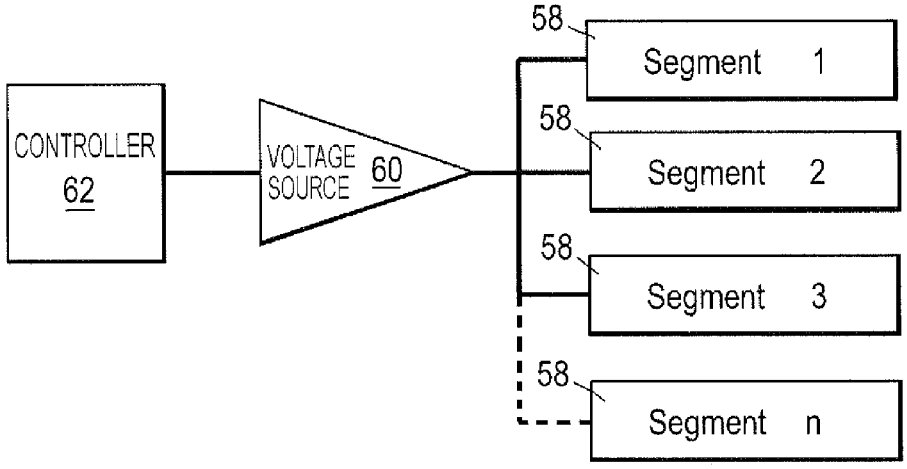
FIG. 5 is a schematic diagram of a first voltage source arrangement.
Figure 6:
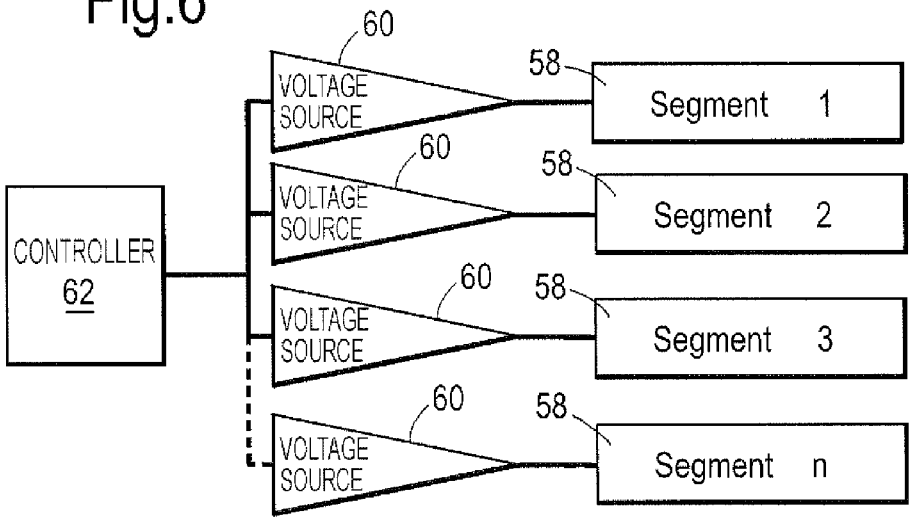
FIG. 6 is a schematic diagram of a second voltage source arrangement.

There is usually a plurality of shroud segments 48 in a circumferential array around a set of rotor blades 44. Thus in accordance with the clearance control arrangement of the present invention, each segment 48 comprises a surface portion 50 having a layer of material 58. FIG. 5 and FIG. 6 show two ways of actuating the layers of piezoelectric material 58. In FIG. 5, the controller 62 sends a control signal to the voltage source 60 which actuates all of the layers of material 58 simultaneously. Thus this represents ganged control which is light as only one voltage source 60 is required. In FIG. 6, there is a voltage source 60 provided for each layer of material 58 so that the controller 62 sends control signals to each voltage source 60 separately. This enables individual control of the clearances 52 between the surface portion 50 of each segment 48 and the passing rotor blades 44. This is advantageous where there is asymmetry between the various segments 48 but is heavier than the FIG. 5 arrangement because there are multiple voltage sources 60. The FIG. 6 arrangement may be beneficial as it offers the potential for redundancy as, in the event that one or more of the voltage sources 60 fails, voltage may be supplied to more than one layer of material 58 by a single voltage source 60.

The clearance control arrangement may also comprise a tip clearance sensor 64, as shown in FIG. 3, that forms part of a feedback control loop with the controller 62. The sensor 64 may be coupled to the outer metal layer 56 so that it measures the true clearance 52. Alternatively, it may be coupled to the segment 48 and arranged to measure displacement of the layer of material 58 in order to derive the remaining clearance 52.

Figure 7:
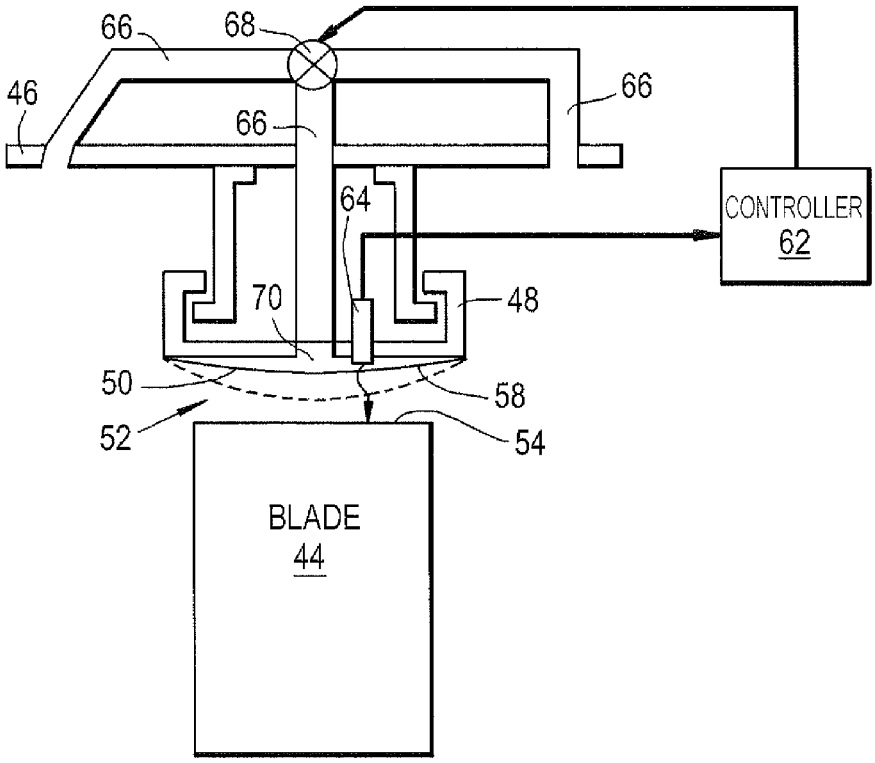
FIG. 7 is a schematic sectional view of a second embodiment of a clearance control arrangement according to the present invention.

FIG. 7 shows a second embodiment of a clearance control arrangement according to the present invention and shares many features with FIG. 3. Thus the casing 46 comprises a shroud segment 48 that has a surface portion 50. A blade 44, which is part of a rotor blade set, has a tip 54 spaced from the surface portion 50 to define a clearance 52. A sensor 64 is arranged to measure the clearance 52, either directly or indirectly by measuring the displacement of the surface portion 50, and to feed back a signal to a controller 62. The controller 62 may be unique to the clearance control arrangement or may be integrated with the engine electronic controller or another extant controller in the engine 10.

In the second embodiment the surface portion 50 comprises a layer of material 58 that is a flexible membrane. An arrangement of three air pipes 66 meet at a three-way valve 68. One of the air pipes 66 couples a source of air, for example compressor exit air or bypass duct air, to the three-way valve 68. A second of the air pipes 66 couples the three-way valve 68 to a discharge aperture, such as downstream of the blades 44 or into the bypass duct 32. A third of the air pipes 66 couples the three-way valve 68 to a cavity 70, one side of which is formed by the flexible membrane 58. The three-way valve 68 acts in a first orientation to divert air from the source through the first of the air pipes 66 to bypass the clearance control arrangement and discharge the air through the second of the air pipes 66. In a second orientation the three-way valve 68 diverts the air from the source through the first of the air pipes 66 and into the third of the air pipes 66 to fill the cavity 70 and thereby distend the flexible membrane to reduce the clearance 52. In a third orientation of the three-way valve 68, air is diverted from the source through both the second and third air pipes 66 so that the flexible membrane 58 is distended to a lesser extent and the additional air is expelled through the second of the air pipes 66. There may be continuous movement of the three-way valve 68 between the three orientations, rather than three discrete orientations.

A controller 62 is coupled to the three-way valve 68 to control its actuation between the three orientations. By using the feedback signal from the sensor 64 and modulating the orientation of the three-way valve 68 accordingly, the flexible membrane 58 can be distended towards the tip 54 of the rotor blade 44 by a sufficient distance to minimise the clearance 52. As in the first embodiment, the sensor 64 may be mounted to the flexible membrane to measure the actual clearance 52 or may be mounted to the segment 48 or elsewhere to measure the displacement of the flexible membrane 58 from the segment 48 from which the clearance 52 may be derived.

Advantageously, the clearance control arrangement of the present invention has a rapid response time which makes it ideal for fast transient control, as is required to compensate for the differential component growth caused by step climb and similar manoeuvres. This means that the clearance 52 is minimised throughout the flight cycle and therefore results in reduced fuel consumption and increased engine efficiency.

All the described embodiments can be arranged to cause a range of movement of the surface portion 50 to control the clearance 52. By providing individual control of the actuators, voltage source 60 or three-way valve 68, the clearance control arrangement of the present invention is able to compensate for asymmetries in the system, such as irregular length blades 44, segment imperfections and irregularities, transient thermal asymmetry of the casing, vibrations, and other combinations of thermomechanical effects.

The clearance control arrangement of the present invention could be used in conjunction with a cooling arrangement for controlling the temperature of the casing. In this way, the cooling arrangement provides relatively large movements of the casing over longer periods, to accommodate blade growth due to creep of the respective blades for example. In such an arrangement, the clearance control arrangement of the present invention provides "fine tuning" of the blade clearance, i.e. relatively small movements of the casing over much shorter periods to accommodate blade growth or shrinkage due to transient temperature changes of the respective blades. As the clearance control arrangement is not required to accommodate large changes in blade length, the control arrangement can be made to be lighter, and therefore respond more quickly to transient changes in blade length. The clearance control arrangement, when used in conjunction with a cooling arrangement, is also simpler and more robust in comparison to prior mechanical clearance control arrangements.

Although specific embodiments of the clearance control arrangement according to the present invention have been described with respect to tip clearance control in a gas turbine engine 10, other embodiments and variations fall within the scope of the claimed invention. The layer of material 58 may comprise a shape memory alloy or other heat-affected material. In this case the actuator would be a heat source instead of the voltage source 60 of the first described embodiment.

For the second embodiment, the flexible membrane 58 may be formed as a plurality of pockets so that the deformation of the flexible membrane 58 is more even across the surface portion 50. The third of the air pipes 66 may split into multiple end portions to feed such pockets. Although a single layer of material 58 has been shown for the surface portion 50 of each segment 48, a plurality of layers of material 58 may be provided instead.

The controller 62 may, control one actuator, the voltage source 60 or the three-way valve 68 or a heat source, which actuates a plurality of layers of material 58. Alternatively the controller 62 may actuate multiple actuators, each of which actuates one or a plurality of layers of material 58 forming part of one or several surface portions 50. Some redundancy may be designed into the system whereby multiple actuators are cross-coupled to the same layers of material 58 so that a failed actuator can be bypassed.

Although a three-way valve 68 has been described, a different arrangement of valves having the same effect may be used instead. For example, three separate valves in combination.

Although the clearance control arrangement of the present invention has been described with respect to application of tip clearance control in an aero gas turbine engine 10, it finds equal utility for tip clearance control in marine or industrial gas turbine engines, and in propeller gas turbine engines. The present invention can also be used with equal felicity for fan duct acoustic control of a gas turbine engine 10 by changing the shape of the fan inlet duct to change the acoustic properties thereof.

The present invention may find utility in other industries, for example in controlling the clearance of contra-rotating shafts and co-rotating shafts e.g. in the automobile and manufacturing industries.

The invention claimed is:

1. A clearance control arrangement comprising:

first and second components defining a clearance therebetween;

the first component comprising a surface portion having at least a layer of piezoelectric material that changes thickness when actuated; and an actuator to actuate the layer of piezoelectric material.

2. A clearance control arrangement as claimed in claim 1 comprising a plurality of first components each defining a clearance relative to the second component and each having at least a layer of piezoelectric material that changes thickness when actuated.

3. A clearance control arrangement as claimed in claim 2 wherein the actuator actuates all the layers of material in synchronicity.

4. A clearance control arrangement as claimed in claim 2 wherein an actuator is provided to actuate each layer of material individually.

5. A clearance control arrangement as claimed in claim 1 wherein the actuator comprises a voltage source.

6. A clearance control arrangement as claimed in claim 1, wherein the surface portion comprises the layer of piezoelectric material sandwiched between layers of metal.

7. A clearance control arrangement as claimed in claim 6 wherein the voltage source is connected to the layers of metal across the layer of piezoelectric material.

8. A clearance control arrangement as claimed claim 1 further comprising a controller to control actuation of the actuator.

9. A clearance control arrangement as claimed in claim 8 further comprising a feedback loop between the sensor output and the controller.

10. A clearance control arrangement as claimed in claim 9 wherein the sensor is coupled to the surface portion.

11. A clearance control arrangement as claimed in claim 9 wherein the sensor is coupled to another part of the first component.

12. A clearance control arrangement as claimed in claim 1 further comprising a sensor to determine the clearance.

13. A clearance control arrangement as claimed in claim 12 wherein the sensor is coupled to the surface portion.

14. A clearance control arrangement as claimed in claim 12 wherein the sensor is coupled to another part of the first component.

15. A gas turbine engine comprising a clearance control arrangement as claimed in claim 1.

16. A gas turbine engine according to claim 15 comprising a clearance control arrangement for tip clearance control wherein the first component comprises a casing segment and the second component comprises a rotating blade.

17. A gas turbine engine according to claim 16 further comprising a cooling arrangement for cooling the casing segment.

18. A gas turbine engine comprising a clearance control arrangement as claimed in claim 1 for fan duct acoustic control.

* * * * *